US007732794B2

(12) United States Patent
Abe et al.

(10) Patent No.: US 7,732,794 B2
(45) Date of Patent: Jun. 8, 2010

(54) EXTREME ULTRA VIOLET LIGHT SOURCE APPARATUS

(75) Inventors: Tamotsu Abe, Odawara (JP); Yoshifumi Ueno, Hiratsuka (JP); Takayuki Yabu, Hiratsuka (JP)

(73) Assignee: Komatsu Ltd., Tokyo (JP)

( * ) Notice: Subject to any disclaimer, the term of this patent is extended or adjusted under 35 U.S.C. 154(b) by 316 days.

(21) Appl. No.: 12/071,250

(22) Filed: Feb. 19, 2008

(65) Prior Publication Data

US 2008/0197298 A1 Aug. 21, 2008

(30) Foreign Application Priority Data

Feb. 20, 2007 (JP) ..... 2007-038751

(51) Int. Cl.
*H01J 35/20* (2006.01)

(52) U.S. Cl. ..... 250/504 R; 250/493.1; 250/494.1; 372/38.07; 372/55; 378/119

(58) Field of Classification Search ..... 250/504 R, 250/493.1, 494.1
See application file for complete search history.

(56) References Cited

U.S. PATENT DOCUMENTS 7,247,870 B2 * 7/2007 Ershov et al. ..... 250/504 R
7,276,710 B2 * 10/2007 Yamamoto et al. ..... 250/492.2
7,365,351 B2 * 4/2008 Bowering et al. ..... 250/504 R
7,476,886 B2 * 1/2009 Bykanov et al. ..... 250/504 R
2008/0048133 A1 * 2/2008 Bykanov et al. ..... 250/504 R
2008/0197298 A1 * 8/2008 Abe et al. ..... 250/504 R
2008/0197299 A1 * 8/2008 Hoshino et al. ..... 250/504 R
2009/0314967 A1 * 12/2009 Moriya et al. ..... 250/504 R

FOREIGN PATENT DOCUMENTS

JP 11-250842 9/1999
JP 2006-244837 9/2006

* cited by examiner

*Primary Examiner*—David A Vanore
(74) *Attorney, Agent, or Firm*—Wenderoth, Lind & Ponack, L.L.P.

(57) ABSTRACT

In an extreme ultra violet light source apparatus having a comparatively large output power for exposing, a solid target is supplied fast and continuously while heat dissipation for irradiation of a driver laser light is performed successfully. The extreme ultra violet light source apparatus includes: a chamber in which extreme ultra violet light is generated; a target material supplying unit which coats a wire with target material, a wire supplying unit which supplies the wire coated with the target material to a predetermined position within the chamber, a driver laser which applies a laser beam onto the wire coated with the target material to generate plasma; and a collector mirror which collects the extreme ultra violet light radiated from the plasma and outputting the extreme ultra violet light.

11 Claims, 7 Drawing Sheets

| KIND OF LASER | WAVELENGTH $\lambda$ | CRITICAL DENSITY Nc |
|---|---|---|
| $CO_2$ LASER | 10.6 $\mu$m | $10^{19}cm^{-3}$ |
| Nd:YAG LASER | 1.06 $\mu$m | $10^{21}cm^{-3}$ |

EXTREME ULTRA VIOLET LIGHT SOURCE APPARATUS

BACKGROUND OF THE INVENTION

1. Field of the Invention

The present invention relates to an extreme ultra violet (EUV) light source apparatus to be used as a light source of exposure equipment.

2. Description of a Related Art

Recent years, as semiconductor processes become finer, photolithography has been making rapid progress to finer fabrication. In the next generation, microfabrication of 100 nm to 70 nm, further, microfabrication of 50 nm or less will be required. Accordingly, in order to fulfill the requirement for microfabrication of 50 nm or less, for example, exposure equipment is expected to be developed by combining an EUV light source generating EUV light with a wavelength of about 13 nm and reduced projection reflective optics.

As the EUV light source, there are three kinds of light sources, which include an LPP (laser produced plasma) light source using plasma generated by applying a laser beam to a target (hereinafter, also referred to as "LPP type EUV light source apparatus"), a DPP (discharge produced plasma) light source using plasma generated by discharge, and an SR (synchrotron radiation) light source using orbital radiation. Among them, the LPP light source has advantages that extremely high intensity close to black body radiation can be obtained because plasma density can be considerably made larger, that light emission of only the necessary waveband can be performed by selecting the target material, and that an extremely large collection solid angle of $2\pi$ steradian can be ensured because it is a point light source having substantially isotropic angle distribution and there is no structure surrounding the light source such as electrodes. Therefore, the LPP light source is considered to be predominant as a light source for EUV lithography requiring power of more than several tens of watts.

Here, there will be explained a principle of the EUV light generation in the LPP type light source apparatus. Target material supplied into a vacuum chamber is irradiated with a laser beam, and the target material is excited into plasma state. From this plasma, light-components with various wavelengths including the EUV light are radiated. Then, a light component with a desired wavelength (e.g., component with a wavelength of 13.5 nm) is selectively reflected and collected by using an EUV collector mirror and outputted to exposure equipment. On the reflecting surface of the EUV collector mirror, for example, a multi-layered film (Mo/Si multi-layered film) is formed by alternately stacking a molybdenum (Mo) thin film and a silicon (Si) thin film.

In such an LPP type EUV light source apparatus, particularly in a case of using a solid target, there is a problem about influence of neutral particles or ions emitted from the plasma. Since the EUV collector mirror is disposed close to the plasma, the neutral particles emitted from the plasma attach to the reflecting surface of the EUV collector mirror to deteriorate reflectivity of the mirror. Meanwhile, the ions emitted from the plasma cut out the multi-layered film formed on the reflecting surface of the EUV collector mirror. Here, flying particles from the plasma including neutral particles and ions and remains of the target material are called as debris.

As a related technology, Japanese Patent Application Publication JP-P2006-244837A discloses a laser plasma radiated light generating apparatus comprising means for supplying material, which is solid at a room temperature, continuously for a long time by using a simple device operated with a simple adjustment. The laser plasma radiated light generating apparatus ejects a solution containing fine particles from a nozzle to generate a liquid jet or a liquid droplet, irradiates the liquid jet or liquid droplet with a pulse laser beam to evaporate the solvent thereof by heat, and consecutively after a delay time of 0.1 μs or more, irradiates the heated liquid jet or liquid droplet with another pulse laser beam to generate-plasma.

Further, Japanese Patent Application Publication JP-A-11-250842 discloses a laser plasma light source which generates little debris and has a high conversion efficiency using a solid target. The laser plasma light source uses a solid target formed with a hollow at a part thereof irradiated with a laser beam, ablates an inside wall of the hollow by using a pulse laser for ablation, irradiates the hollow with a pulse laser beam for heating, after having waited for generation of a high density portion of evaporated material in the space within the hollow, and then excites the high density portion into high temperature plasma to generate a radiation.

SUMMARY OF THE INVENTION

Generally, as the solid target material, there is used tin having high conversion efficiency from driver laser light energy to EUV light energy. However, solid tin melts and flies off at an elevated temperature by irradiation of the driver laser, and debris thereof deteriorates an efficiency to generate the EUV light. Therefore, conventionally, a target in a state of a droplet, in which fine particles of tin with diameters of about 20 μm to 200 μm are dispersed into liquid, is transferred into an irradiation space of a laser beam thereby to minimize debris generated.

Recently, however, it has been confirmed that combination of a $CO_2$ laser and tin target reduces significantly an amount of debris generated from the tin by irradiation of a laser beam. This shows a possibility of using solid tin as the target. In the past, as means for supplying a solid target continuously, it is known to reciprocate a plate-formed target, to supply and rewind a tape-formed target, or to rotate and reciprocate a rod target, and they are limitedly applied mainly to a low repetition frequency irradiation with low output power.

However, in an EUV light source to be used for exposure equipment for a large scale production, a target is irradiated with driver laser light having a power of about 10 kW at a repetition frequency of about 100 kHz. Therefore, it is required to supply the target fast and continuously, and further, it becomes a problem how to dissipate heat caused by irradiation of the driver laser light having the power of about 10 kW.

The present invention has been achieved in view of these problems. The purpose of the present invention is to supply a solid target fast and continuously while successfully dissipating heat caused by irradiation of driver laser light in an extreme ultra violet light source apparatus having a comparatively large output power for exposing.

In order to accomplish the above purpose, an extreme ultra violet light source apparatus according to one aspect of the present invention is an extreme ultra violet light source apparatus for generating extreme ultra violet light by applying a laser beam onto target material, and includes: a chamber in which extreme ultra violet light is generated; a target material supplying unit which coats a wire with target material; a wire supplying unit which supplies the wire coated with the target material to a predetermined position within the chamber; a driver laser which applies a laser beam onto the wire coated with the target material to generate plasma; and a collector mirror which collects the extreme ultra violet light radiated from the plasma and outputs the extreme ultra violet light.

According to the present invention, a wire coated with target material is irradiated with a laser beam, and thereby, a solid target can be supplied fast and continuously while heat caused by irradiation of driver laser light is being successfully dissipated.

BRIEF DESCRIPTION OF THE DRAWINGS

FIG. 4 is a diagram illustrating a detailed configuration of a wire supplying unit and so on;

DESCRIPTION OF THE PREFERRED EMBODIMENTS

Figure 1:
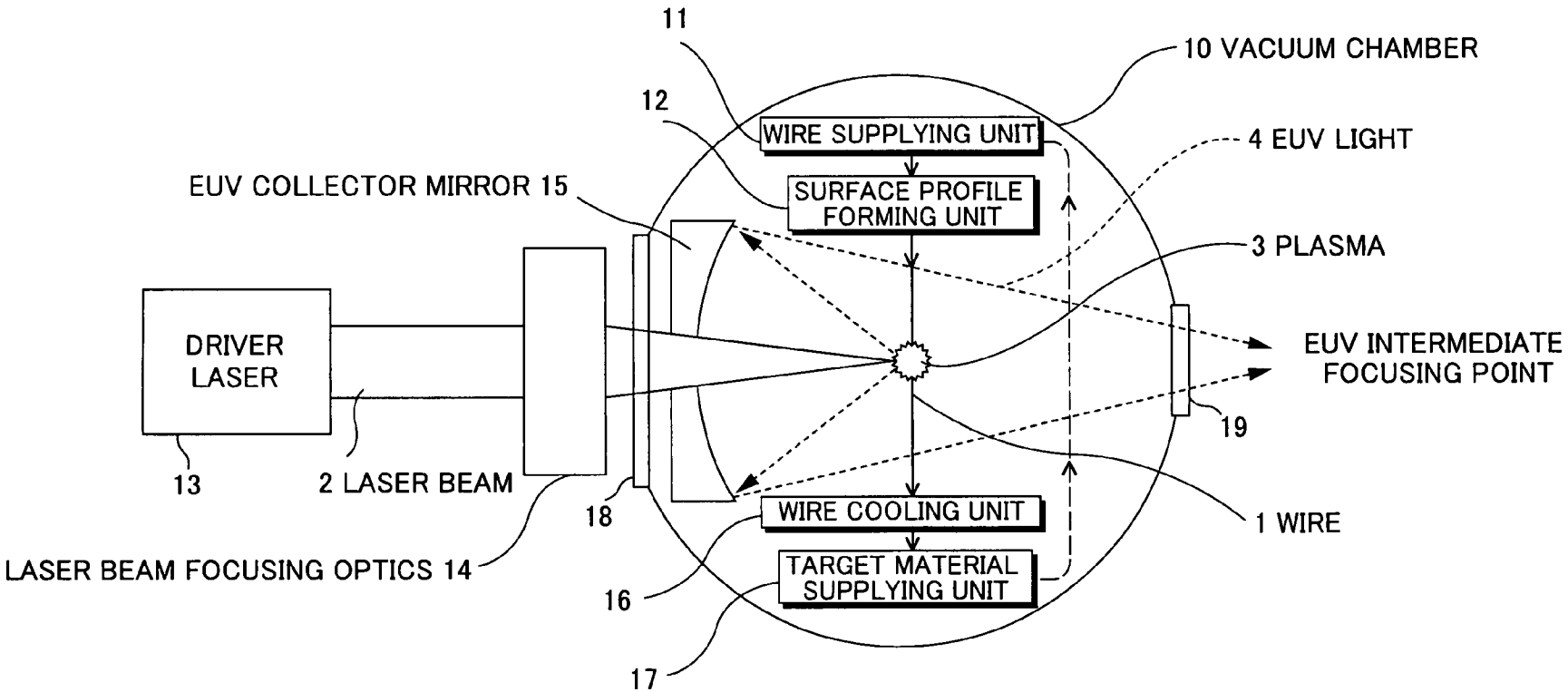
FIG. 1 is a schematic diagram illustrating a configuration of an EUV light source apparatus according to a first embodiment of the present invention.

Hereinafter, embodiments of the present invention will be described in detail with reference to the drawings. Here, the same constituent elements are denoted by the same reference numeral and description thereof will be omitted.

FIG. 1 is a schematic diagram illustrating a configuration of an EUV light source apparatus according to a first embodiment of the present invention. The EUV light source apparatus according to the present embodiment employs the laser produced plasma (LPP) type in which EUV light is generated by excitation of target material with irradiation of a laser beam.

As shown in FIG. 1, the EUV light source apparatus is provided with a vacuum chamber 10 in which the EUV light is generated, a wire supplying unit 11 for supplying a wire 1 coated with target material to a predetermined position in the vacuum chamber 10, a surface profile forming unit 12 for forming a surface profile of the wire 1 coated with the target material, a driver laser 13 for generating an exciting laser beam 2 to be applied onto the wire 1 coated with the target material, a laser beam focusing optics 14 for focusing the exciting laser beam 2 generated by the driver laser 13, an EUV collector mirror 15 for collecting and outputting EUV light 4 emitted from plasma 3 generated by applying the exciting laser beam 2 onto the wire 1 coated with the target material, a wire cooling unit 16 for cooling the wire 1 applied with the laser beam, and a target material supplying unit 17 for coating the wire 1 cooled by the wire cooling unit 16 with the target material.

The vacuum chamber 10 is provided with an input window 18 for inputting the exciting laser beam 2 and an output window 19 for outputting the EUV light radiated from the plasma 3 to exposure equipment. Here, the inside of the exposure equipment is kept in vacuum or a reduced pressure state as well as the inside of the vacuum chamber 10. In the present embodiment, the wire supplying unit 11, the surface profile forming unit 12, the wire cooling unit 16, and the target material supplying unit 17 are disposed inside the vacuum chamber 10.

The wire 1 coated with the target material is transferred by the wire supplying unit 11, formed to have a surface profile suitable for EUV light generation by the surface profile forming unit 12, and then supplied to the predetermined position within the vacuum chamber 10.

The driver laser 13 is a laser beam source capable of performing pulse-oscillation at a high repetition frequency (e.g., a pulse width of about several nanoseconds to several tens of nanoseconds, and a repetition frequency of about one kilohertz to one hundred kilohertz). Further, the laser beam focusing optics 14 is constituted from at least one lens and/or at least one mirror. The laser beam 2 focused by the laser beam focusing optics 14 irradiates the wire 1 coated with the target material at the predetermined position within the vacuum chamber 10, and thereby, part of the target material is excited into plasma state and light components with various wavelengths are radiated from an emitting point. Here, the emitting point means a position where the plasma 3 is generated.

The EUV collector mirror 15 is a collecting optics for collecting a light component with a predetermined wavelength (e.g., EUV light with a wavelength near 13.5 nm) by selective reflection among the light components with various wavelengths radiated from the plasma 3. The EUV collector mirror 15 has a concave reflecting surface, on which a multilayered film of molybdenum (Mo) and silicon (Si) is formed to selectively reflect the EUV light with a wavelength near 13.5 nm, for example.

In FIG. 1, the EUV light is reflected in a right direction by the EUV collector mirror 15 and collected to an intermediate focusing point, and then output into the exposing device. Here, the collecting optics of the EUV light is not limited to the EUV collector mirror 15 as shown in FIG. 1, and may be constituted by a plurality of optical components. In this case, however, the alternative optics needs to be also a catadioptric system for suppressing EUV light absorption thereof.

The wire 1 irradiated with the laser beam 2 is cooled by the wire cooling unit 16. While part of the wire 1 irradiated with the laser beam 2 lacks the target material, this is filled by the target material supplying unit 17, and thereby, the target material can be continuously supplied. The wire 1 coated with the target material by the target material supplying unit 17 is retrieved by the wire supplying unit 11.

In the present embodiment, as the driver laser 13, a CO2 laser is used which can generate light having a comparatively long wavelength. Further, as the target 1, tin (Sn) is used. The reason is as follows.

Generally, when plasma is generated by applying a laser beam onto a target, there is known a case that a melted layer of a target surface boils suddenly or part of a melted target is ejected as particles by an expanding force of plasma applied to the target (refer to Kobayashi et al. "Ablation plasma generation-control 1 (Laser)", Journal of Plasma and Fusion Research, Vol. 76, No. 11 (November 2000), pp. 145-1150), which is incorporated herein by reference.

In particular, in plasma light source using a solid target, there are a high temperature low density plasma region that generates a radiation in a short wavelength band such as the EUV light and a low temperature high density plasma region that does not generate a radiation in the short wavelength band. In these regions, the low temperature high density plasma region becomes a heat source that generates a lot of debris from the target material after the laser beam irradiation. This heat source forms a melted layer on the surface of the target and a melted metal is ejected by the expanding force of the plasma to fly off, resulting in the debris generated.

This process will be described in detail. When a laser beam irradiates target material, the target material is heated and ionized by the laser beam to generate plasma. Then, the laser beam is absorbed in the plasma. A mechanism of the laser beam absorption in the plasma is an absorption mechanism that is an inverse process of bremsstrahlung in which an electromagnetic wave (laser beam) is radiated when an electron gets acceleration in an electric field of an ion, and it is called inverse bremsstrahlung. The inverse bremsstrahlung is the most basic absorption mechanism occurring in laser generation plasma, and is also called a classic absorption. Electrons vibrated by a high frequency electric field causes energy absorption while colliding with ions.

In plasma, an electromagnetic wave (laser beam) can be propagated only when having a higher frequency than an electron plasma frequency. That is, when an angular frequency of an laser beam is denoted by $\omega_L$ and a angular frequency of an electron plasma is denoted by $\omega_P$, the laser beam can be propagated only in a low density plasma region where $\omega_L > \omega_P$. Here, plasma electron density $N_E$ which provides $\omega_L = \omega_P$ is called as a critical density $N_C$.

In cases where a solid target is irradiated with a laser beam, there exists plasma ejecting and expanding from the target surface. Therefore, the laser beam is propagated from a lower density region to a higher density region in the plasma while being absorbed, and is reflected in the critical density region. That is, the laser beam is absorbed in going paths to the critical density region and returning paths from the critical density region in the plasma. Accordingly, when the critical density is higher, higher density plasma can absorb energy, but, at the same time, there arises a greater risk of generating a low temperature high density plasma region which causes debris generation.

The critical density $N_C$ is represented by the following formula.

$$N_C(\mathrm{cm}^{-3}) = 1.11\times10^{13}/\lambda^2$$

where $\lambda$ represents a laser beam wavelength.

Figures 2, 3:
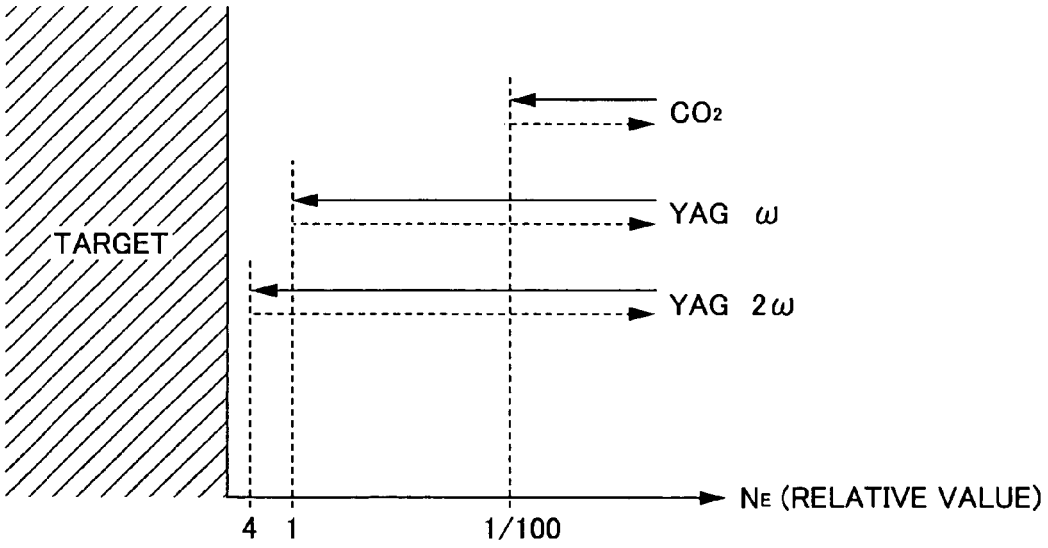
FIG. 2 is a diagram showing wavelengths and critical densities of a $CO_2$ laser and a Nd:YAG laser.
FIG. 3 is a diagram illustrating condition in which laser beams are reflected from the vicinity of a target.

FIG. 2 shows wavelengths and critical densities of a $CO_2$ laser and a Nd:YAG laser. The $CO_2$ laser has an output laser beam with a one order longer wavelength $\lambda$ and thereby provides a two order lower critical density $N_C$, compared with the Nd:YAG laser. As a result, as shown in FIG. 3, a laser beam output from the $CO_2$ laser is reflected at a high temperature low density region considerably distant from a target surface. Here, in FIG. 3, the horizontal axis represents plasma electron density $N_E$ corresponding to a distance from the target surface. Further, as to the Nd:YAG laser, there is shown a case of a fundamental wave $\omega$ (wavelength of 1,064 nm) and a case of the second harmonic wave $2\omega$ (wavelength of 532 nm).

Using the $CO_2$ laser for the driver laser suppresses generation of the low temperature high density plasma region, which becomes a heat source generating debris rather than contributing to generate the EUV light, and thereby, hinders melting of the surface of the solid target, and reduces significantly neutral particles which are emitted from the target and attach to the reflecting surface of the EUV collector mirror. On the other hand, a high-speed ion radiated also from plasma cuts off the multi-layered film formed on the reflecting surface of the EUV collector mirror.

In the case where tin (Sn) target is used, neutral particles generated from the target are significantly reduced, and therefore, it is verified possible to balance an amount of the neutral particles attaching to the reflecting surface of the EUV collector mirror (deposition amount) and an amount of the multi-layered film cut off from the reflecting surface of the EUV collector mirror (sputtering amount), or to make the deposition amount smaller than the sputtering amount, under a predetermined condition. This can solve a problem that debris attaches to the surface of the EUV collector mirror.

The condition thereof is determined mainly by the intensity and/or the pulse width of the exciting laser beam generated by the $CO^2$ laser. Specifically, the intensity of the exciting laser beam is determined preferably to be $3\times10^9$ W/cm$^2$ to $5\times10^{10}$ W/cm$^2$, and more preferably to be $5\times10^9$ W/cm$^2$ to $3\times10^{10}$ W/cm$^2$. Further, the pulse width of the exciting laser beam is preferably determined to be comparatively short as about 10 ns to 15 ns.

The exciting laser beam has an upper limit in the intensity thereof so as not to expand unnecessarily a melted area on a target surface by providing excessive heat to the target, and thereby, debris generation can be suppressed. On the other hand, the intensity of the exciting laser provide a great effect to an EUV conversion efficiency (CE) and thereby has a lower limit to keep the EUV conversion efficiency better than a certain level. The relationship between the exciting laser beam intensity and the EUV conversion efficiency is also disclosed in Hansson et al. "LPP EUV Source Development for HVM", SPIE, Vol. 6151, No. 61510R (February 2006), which is incorporated herein by reference.

Here, the laser beam intensity is represented by the following formula.

$$\text{Laser beam intensity (W/cm}^2) = \text{Laser beam energy } (J)/\{\text{Pulse width}(s)\cdot\text{Spot area(cm}^2)\}$$

In the present embodiment, since the diameter of a collected laser beam is substantially 100 μm, the spot area of the laser beam is substantially $7.85\times10^{-5}$ cm$^2$, and the laser beam energy is determined to meet these conditions. For example, if the pulse width of the exciting laser beam is 12.5 ns, the laser beam energy becomes substantially 30 mJ.

Figure 4:
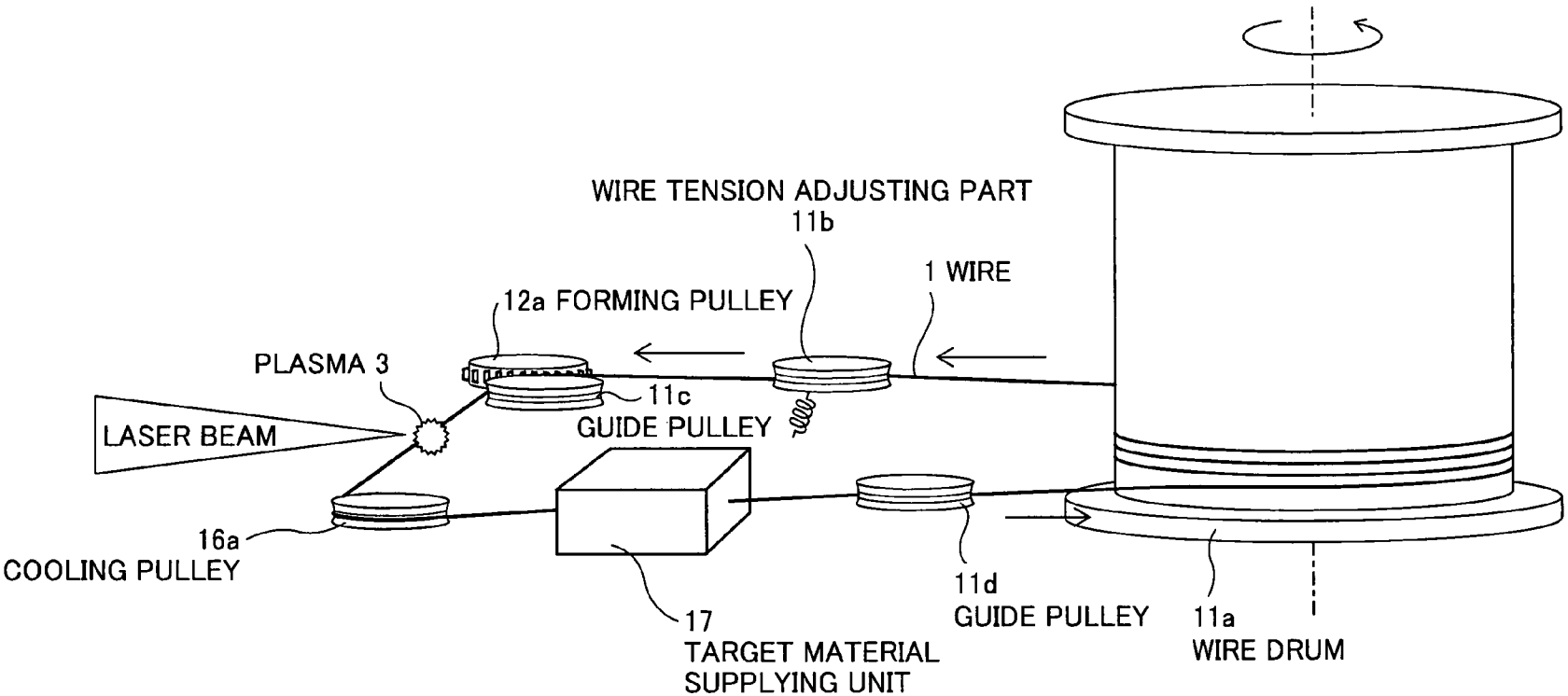

FIG. 4 is a diagram illustrating detailed configuration of the wire supplying unit and so on shown in FIG. 1. In the present embodiment, the wire supplying unit 11 (FIG. 1) includes a wire drum 11*a*, wire tension adjusting part 11*b*, and guide pulleys 11*c* and 11*d*. The wire drum 11*a*, around which the loop wire 1 is wound, transfers the wire 1 and retrieves the wire 1 by rotation. The wire tension adjusting part 11*b* is constituted from, for example, a tension pulley biased with a spring and adjusts a tension of the wire 1 with a spring force. The guide pulleys 11*c* and 11*d* define trajectory of the wire 1.

Rotating the wire drum 11*a* enables the wire 1 coated with the target material to be supplied continuously. Considering the wire 1 might be damaged, the wire 1 is wound more than several turns around the wire drum 11*a* for keeping a stock of the wire 1. After being used predetermined times, the wire 1 is replaced with a new one.

Materials capable of being used for the wire 1 include metals having an excellent thermal conductivity such as cupper (thermal conductivity of 390 W/mK), tungsten (thermal conductivity of 130 W/mK), and molybdenum (thermal conductivity of 145 W/mK), and metals having a high melting point such as tungsten (melting point of 3,382° C.), tantalum (melting point of 2,996° C.), and molybdenum (melting point of 2,622° C.). Alternatively, a wire having a multi-layered structure may be used. For example, it is possible to use a wire made of a multi-layered coating of cupper and diamond on a stainless core wire such as used for cutting a hard material. In the present embodiment, tungsten having an excellent thermal conductivity and a high melting point is used for the material of the wire 1. Further, the wire 1 needs to have a diameter (e.g., about several millimeters) such that the wire can be robust against deformation required for the winding around the wire drum 11*a*. Also for efficient heat dissipation, it is better for the diameter of the wire 1 to be greater to some extent.

Further, as the surface profile forming unit 12 (FIG. 1), a forming pulley 12*a* which has a plurality of protrusions meshing with a grove of the guide pulley 11*c* is provided. In the case where a tin plate is irradiated with a laser beam to generate the EUV light, it is known that the tin plate better has a grove or a hollow on the surface thereof. Therefore, the forming pulley 12*a* rotates together with the guide pulley 11*c* when the wire 1 is transferred, and pushes the plurality of protrusions to the wire 1, and thereby, forms V-shape grooves or hollows having a predetermined profile on the surface of the tin coated on the wire 1. Thereby, the generation efficiency of EUV light is improved and a highly efficient EUV light source can be realized.

In that case, a transfer speed of the wire 1 and a pitch of the protrusions of the forming pulley 12*a* need to be arranged such that a repetition period of the driver laser 13 (FIG. 1) and a pitch of the grooves or hollows formed on the wire 1 correspond to each other. Further, a profile of the protrusions of the forming pulley 12*a* is arranged so as to increase the generation efficiency of the EUV light. For example, the protrusion of the forming pulley 12*a* has a cylindrical shape and the diameter or the height thereof is optimized.

Alternatively, as the surface profile forming unit 12 (FIG. 1), a hollow may be formed on the surface of the target material coated on the wire 1 by using a laser instead of the forming pulley 12*a*. For example, it is possible to irradiate repeatedly the wire 1 with a laser beam from the driver laser 13 shown in FIG. 1 by controlling the rotation direction and the rotation speed of the wire drum 11*a*, and thereby, the hollow may be formed by the first laser beam irradiation and the plasma 3 may be generated by the second laser beam irradiation.

In order to cool the wire 1, the temperature of which has been increased by the laser beam irradiation, a cooling pulley 16*a* cooled with cooling water is provided as the wire cooling unit 16 (FIG. 1). Here, the wire 1 and the cooling pulley 16*a* are disposed in a vacuum, and therefore, there is a possibility that insufficient contact between the wire 1 and the cooling pulley 16*a* causes a kind of thermal insulation to prevent the heat of the wire 1 from being dissipated.

Figure 5A:
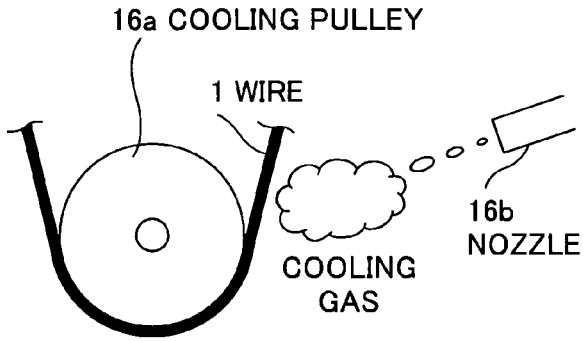
FIGS. 5A and 5B are diagrams illustrating examples of a configuration for expediting heat dissipation of a wire.
Figure 5B:
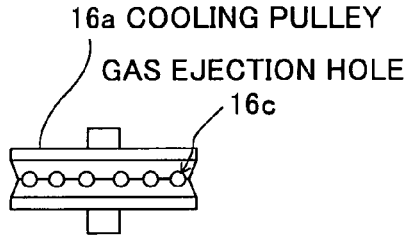

Accordingly, as shown in FIG. 5A, a nozzle 16*b* may be provided near the cooling pulley 16*a*, and a low temperature cooling gas such as argon (Ar) or helium (He) may be made to flow from the nozzle 16*b* toward the wire 1 and the cooling pulley 16*a*, and thereby, the heat dissipation of the wire 1 will be expedited. Alternatively, as shown in FIG. 5B, gas ejection holes 16*c* may be formed in the cooling pulley 16*a*, and the low temperature cooling gas such as argon or helium may be made to flow from the gas ejection holes 16*c* toward the wire 1, and thereby, the heat dissipation of the wire 1 will be expedited.

The cooling pulley 16*a* may be disposed far from the plasma generation point or may be disposed close to the plasma generation point. In an extreme case, the cooling pulley 16*a*may be disposed on the rear side of the part of the wire 1 irradiated with the laser beam. In that case, since the cooling pulley 16*a* is disposed in an EUV light path, the cooling pulley 16*a* is desired to be made thinner so as not to interrupt the EUV light. Further, a plurality of cooling pulleys may be disposed.

Even in the case where the wire 1 has a high heat resistance, when the temperature of the wire 1 exceeds 232° C., there is a case that coated tin melts and thereby reduces the EUV conversion efficiency (CE) or a case that the melted tin flies off to attach to the other members. To solve these problems, it is desirable to control an ultimate temperature in the temperature rise of the wire 1 to be equal to or less than substantially 230° C. lower than the melting point of tin (232° C.) For this purpose, it may be effective to increase the transfer speed of the wire 1, but a more effective way is a preliminary cooling method in which the wire 1 is preliminarily cooled and the cooled wire 1 is supplied into the plasma generation space.

Figure 6A:
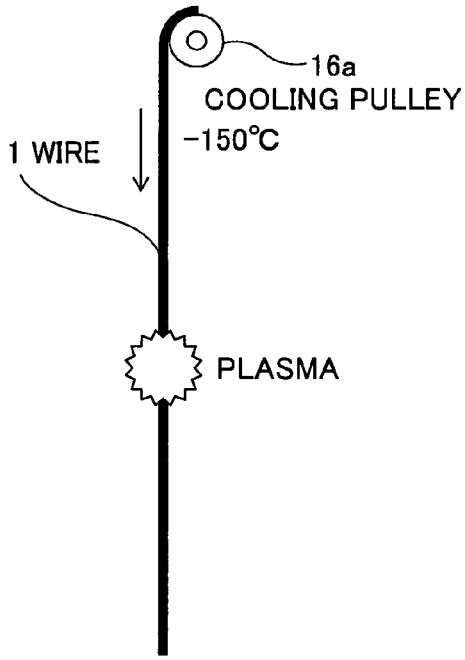
FIGS. 6A and 6B are diagrams illustrating examples of a configuration for preliminary cooling.
Figure 6B:
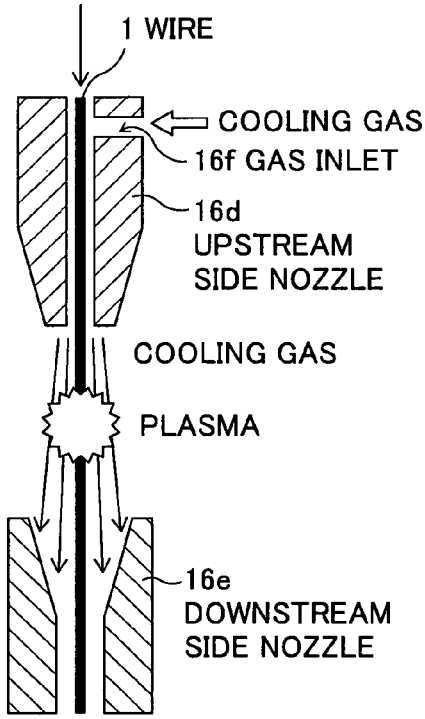

FIGS. 6A and 6B are diagrams illustrating configuration examples for performing the preliminary cooling. As shown in FIG. 6A, the wire 1 is cooled to −150° C. by the cooling pulley 16*a*, and then, the wire 1 is transferred into the plasma generation space, and thereby, a temperature rise margin up to the melting point of tin becomes substantially 380° C. By this method, even in the case where the wire 1 is irradiated with a laser beam from a high power laser, tin does not melt as far as the temperature rise of the wire 1 is 380° C. or less and tin in the original solid state can be supplied into the plasma generation space. Thereby, the EUV light can be generated stably.

Alternately, as shown in FIG. 6B, an upstream side nozzle 16*d* and a downstream side nozzle 16*e* may be provided to feed the wire 1 through the insides thereof. A low temperature cooling gas such as argon or helium may be supplied from a gas inlet 16*f* provided at a predetermined position of the upstream side nozzle 16*d* into the inside of the upstream side nozzle 16*d*, and the low temperature cooling gas maybe sprayed to the periphery of the wire 1. Since the evaporation temperature of the argon gas is substantially −180° C. and the evaporation temperature of the helium is substantially −268° C., the use of the helium gas for the cooling gas can make a cooling effect greater.

Figure 7:
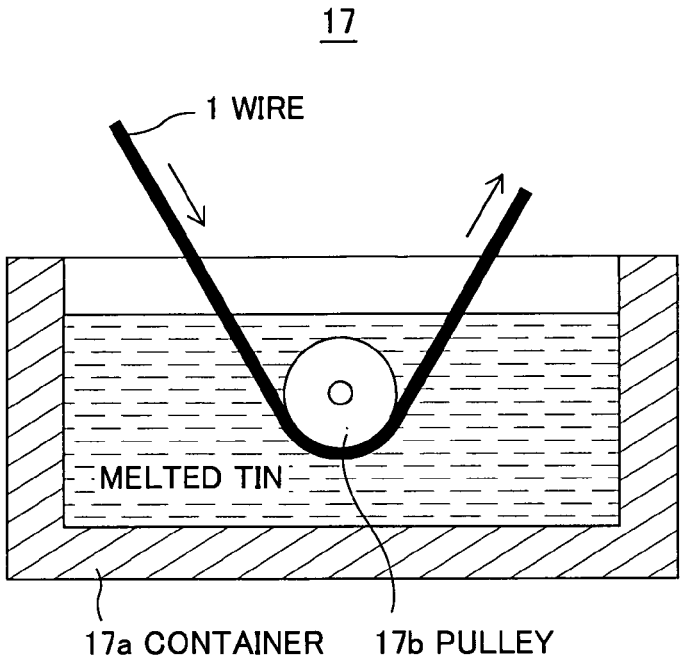
FIG. 7 is a diagram illustrating a first specific example of the target material supplying unit shown in FIG. 1.

FIG. 7 is a diagram illustrating a specific example of the target material supplying unit shown in FIG. 1. The target material supplying unit 17 has a container 17*a* for storing melted tin and a pulley 17*b* rotatably held inside the container 17*a*. Solid tin is put into the container 17*a* kept at not less than substantially 235° C. higher than the melting point of tin (232° C.), and melted to form a tin bath. Since tin has a low vapor pressure in a vacuum, little tin vapor is generated by melting tin. Accordingly, the container 17*a* is not required to be hermetic and can be disposed in a vacuum in an open state. Further, the container 17*a* is easily replenished with tin. For expediting re-melting of tin, it is desirable to control the temperature of melted tin to, for example, 500° C. higher than the melting point of tin (232° C.) and lower than the vaporization temperature of tin (2,602° C.).

As the material of the pulley 17*b*, stainless steel (SUS) can be used, for example. In order to repair the wire 1 which has a damaged surface state because of tin lacking caused by the laser beam irradiation, the wire 1 is fed through the melted tin in the container 17*a* guided by the pulley 17*b*, and thereby, tin on the surface of the wire 1 is melted and reattachment of tin is carried out. In this manner, the wire 1 is put into the melted tin, and tin on the surface thereof is once melted and tin reattaches from the melted tin to the surface of the wire 1.

Then the wire 1 to which tin has attached is cooled, and thereby, the tin target, which always has a new surface state, can be supplied.

Figure 8:
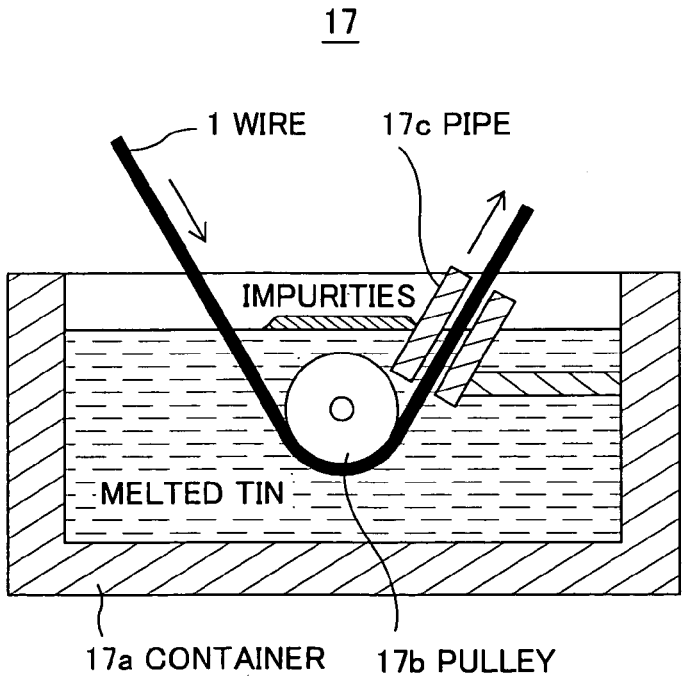
FIG. 8 is a diagram illustrating a second specific example of the target material supplying unit shown in FIG. 1.

As to problems, impurities such as tin oxide floating on the surface layer of the melted tin attaches to the wire 1 resulting in an adverse effect to the EUV generation from the plasma, and tin having attached to the wire 1 is not melted and the diameter of the wire 1 after the reattachment becomes non-uniform. For the former problem, it is effective to provide means for preventing the tin oxide from generating by replacing the inside of the container 17*a* with a gas such as hydrogen. Alternatively, as shown in FIG. 8, as means for removing the impurities floating on a surface layer (liquid level) of the melted tin, a pipe 17*c* having a hole diameter slightly larger than the diameter of the wire 1 is provided on an output side of the wire 1 in the container 17*a*, and thereby, an amount of the impurities attaching to the wire can be reduced. Here, the lower end of the pipe 17*c* is positioned on the lower side of the liquid level of the melted tin, and the upper end of the pipe 17*c* is positioned on the upper side of the liquid level of the melted tin.

Figure 9:
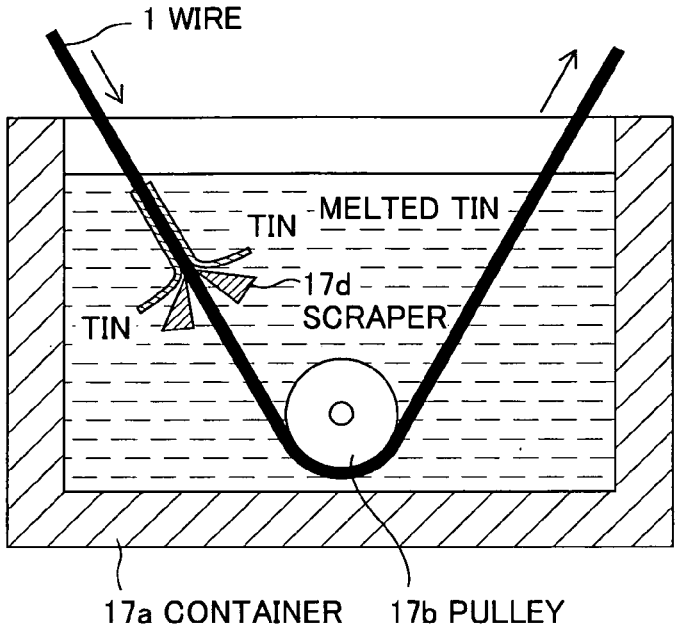
FIG. 9 is a diagram illustrating a third specific example of the target material supplying unit shown in FIG. 1.

For the latter problem, it is effective to control the temperature of the melted tin to be increased up to degree of 1,000° C. Alternatively, as shown in FIG. 9, as means for removing mechanically the tin coated on the wire 1 in the melted tin, a scraper 17*a* may be provided in the container 17*d*. Here, the scraper 17*d* is positioned on the lower side of the liquid level of the melted tin.

Further, in order to expedite and stabilize attachment of tin onto the wire 1 in the melted tin, the surface roughness of the wire 1 may be intentionally increased, or the surface of the wire 1 may be applied with a finishing like knurling. Furthermore, as the material of the wire 1, a material having a good attachment property for tin such as cupper may be used. Moreover, in order to stabilize the diameter of the wire 1 including reattached tin layer, a forming pulley may be provided. Thereby, it is possible to keep uniform the diameter of the wire including the attached tin layer.

Figure 10:
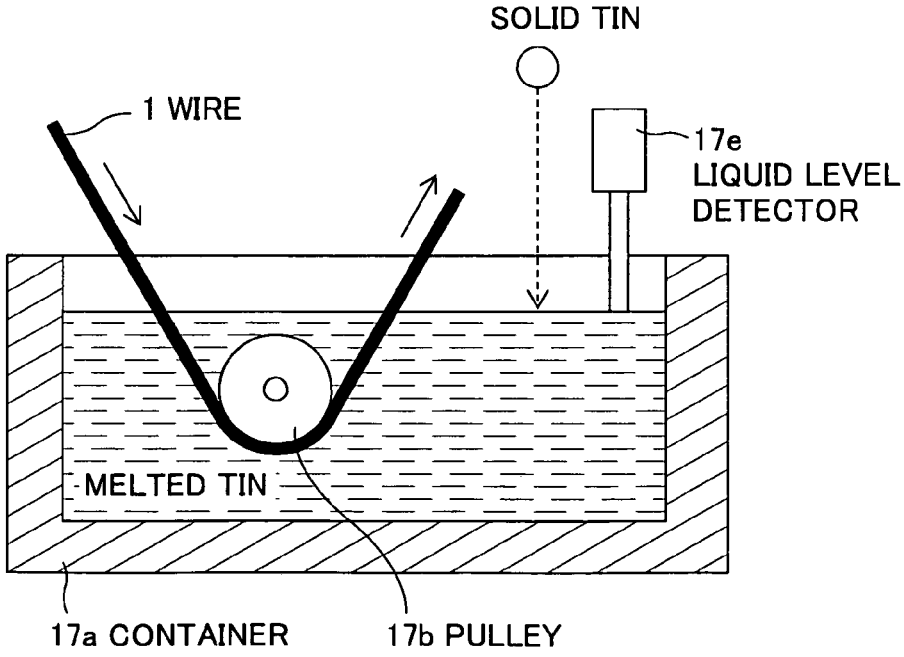
FIG. 10 is a diagram illustrating a fourth specific example of the target material supplying unit shown in FIG. 1.

Since an amount of the melted tin in the container 17*a* decreases gradually, it is necessary to replenish tin appropriately. As shown in FIG. 10, a liquid level detector 17*e* monitoring the liquid level of the melted tin is provided in the container 17*a*, and, when the liquid level becomes lower than a predetermined level, solid tin is put into the melted tin and the tin replenishing is carried out. As the liquid level detector 17*e*, for example, a thermo-couple for detecting the liquid level by temperature or a laser displacement meter for detecting the liquid level by laser light reflection can be used. According to the present embodiment, only a surface part irradiated with the laser beam flies off from the tin coated on the wire 1, and tin consumption can be smaller compared with a case using a tin droplet as the target.

Next, a second embodiment of the present invention will be described.

Figure 11:
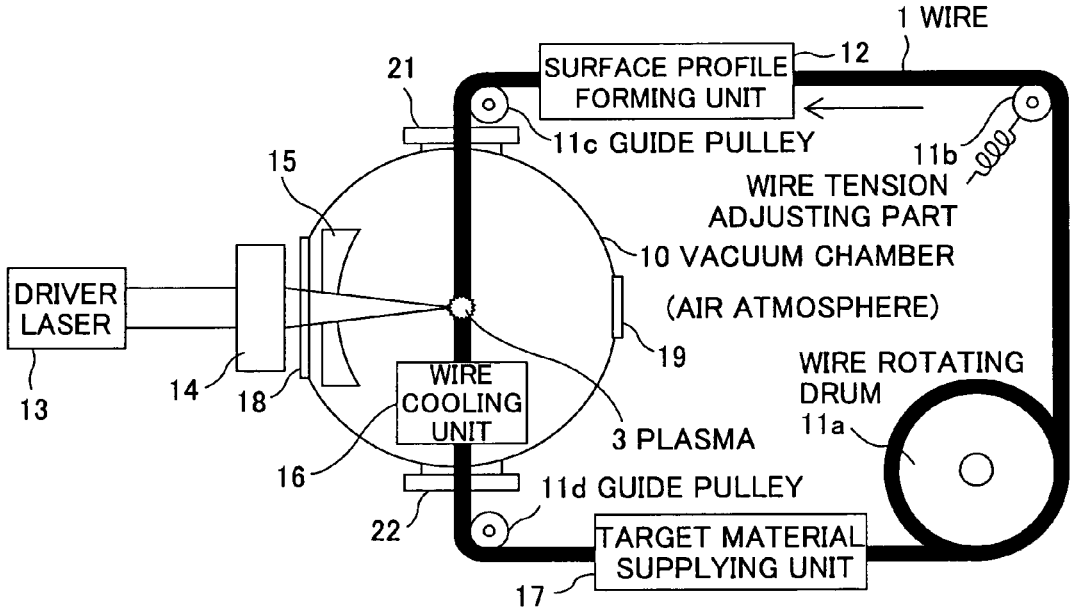
FIG. 11 is a diagram illustrating a configuration of an EUV light source apparatus according to a second embodiment of the present invention.

FIG. 11 is a diagram illustrating a configuration of an EUV light source apparatus according to the second embodiment of the present invention. In the EUV light source apparatus according to the present embodiment, a wire cooling unit 16 is disposed inside a vacuum chamber 10, while a wire supplying unit (wire drum 11*a*, wire tension adjusting part 11*b*, and guide pulleys 11*c* and 11*d*), a surface profile forming unit 12, and a target material supplying unit 17 are disposed outside the vacuum chamber 10 (in the air atmosphere).

Accordingly, in transferring a wire 1 from air to a vacuum and back to the air, it is necessary to provide pressure retaining means for retaining a vacuum of the vacuum chamber 10. In FIG. 11, the pressure retaining means is provided at a wire inputting part 21 and a wire outputting part 22 of the vacuum chamber 10. The other points are the same as the first embodiment.

Figure 12:
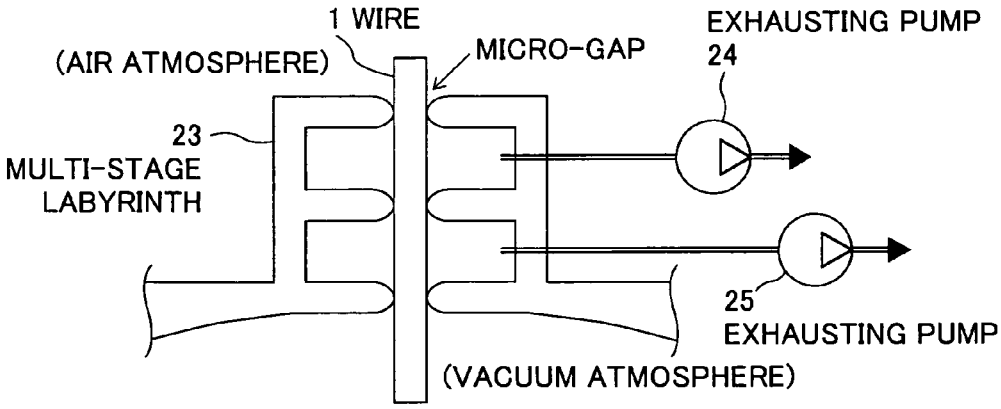
FIG. 12 is a diagram illustrating a specific example of a pressure retaining means to be used in the second embodiment of the present invention.

FIG. 12 is a diagram illustrating a specific example of the pressure retaining means to be used in the second embodiment of the present invention. As shown in FIG. 12, a member (multistage labyrinth) 23, which is constituted by arranging a plurality of plates in parallel, each of the plates having an opening with a diameter slightly larger than that of the wire 1, is used for separating an air atmosphere transferred through and a vacuum atmosphere. When the wire 1 is let into the opening of the multistage labyrinth 23, a micro-gap is generated between each of the plates and the wire 1. Accordingly, by vacuum pumping of spaces among the plates by using exhausting pumps 24 and 25, it is possible to keep a pressure difference between the air atmosphere and the vacuum atmosphere.

Although the multi-stage labyrinth 23 is preferably not contact with the wire 1, the multi-stage labyrinth 23 may come into contact with the wire 1 when the multi-stage labyrinth 23 is made from a flexible material such as rubber, for example. Further, the opening of the plate may be formed by piercing a pipe shaped member through the plate, instead of forming the hole in the plate. According to the present embodiment, the wire supplying unit and so on are disposed outside the vacuum chamber 10. Thereby, the wire 1 is easily exchanged, and the mechanisms such as the wire drum 11*a* need not be accommodated within a vacuum, resulting in a low cost production of an EUV light source apparatus.

Next, as a target of the EUV light source apparatus, there will be compared three cases of: a case of using a wire coated with tin as described in the first and second embodiments of the present invention, a case of using a tin plate, and a case of using a tin droplet.

Regarding continuity in the transfer direction of the target, the use of the tin-coated wire and the use of the tin plate have advantages. In these cases, it is possible to select arbitrarily a repetition frequency of the driver laser light. On the other hand, in the case of using the tin droplet, the repetition frequency of the driver laser light is limited depending on a droplet generation frequency, and a control for synchronization thereof is required to make the apparatus complicated.

Regarding the EUV conversion efficiency (CE), the use of the tin coated wire and the use of the tin plate have advantages. In the case of using the tin droplet, a pre-pulse laser is necessary for increasing the CE and the cost becomes higher.

Regarding an EUV light capturing efficiency, the use of the tin coated wire and the use of the tin droplet have advantages. In the case of using the tin plate, an area where the EUV light is interrupted by the target becomes larger and the EUV light capturing efficiency becomes reduced.

Regarding repetition easiness of the target supplying, the use of the tin-coated wire has an advantage. In that case, the wire can be irradiated repeatedly with the driver laser light and a wire supply speed of degree of 10 m/s is sufficiently high. On the other hand, supplying the tin plate in a speed of 10 m/s makes handling of the tin plate difficult and requires a great amount of tin material. Further, in the case of using the tin droplet, a supply speed of the droplet is required to be degree of 100 m/s for making the repetition frequency of the driver laser to be 100 kHz.

Regarding heat dissipation easiness of the target, the use of the tin coated wire and the use of the tin droplet have advantages. In the case of using the tin coated wire, the heat dissipation is easy just like a rotating electrode and, when the core material thereof is tungsten or the like, the wire is not cut even at a temperature where tin melts. On the other hand, in the case of using the tin plate, a cooling plate is necessary to be provided in the back of the tin plate.

Regarding debris generation, although the use of the tin droplet has an advantage, the debris generation can be suppressed by selection of the conditions as described above also in the case of using the solid tin.

The invention claimed is:

1. An extreme ultra violet light source apparatus for generating extreme ultra violet light by applying a laser beam onto target material, said apparatus comprising:

a chamber in which extreme ultra violet light is generated;

a target material supplying unit which coats a wire with target material;

a wire supplying unit which supplies the wire coated with the target material to a predetermined position within said chamber;

a driver laser which applies a laser beam onto the wire coated with the target material to generate plasma; and a collector mirror which collects the extreme ultra violet light radiated from said plasma and outputs the extreme ultra violet light.

2. The extreme ultra violet light source apparatus according to claim 1, wherein said driver laser includes a $CO_2$ laser.

3. The extreme ultra violet light source apparatus according to claim 1, wherein said target material includes tin.

4. The extreme ultra violet light source apparatus according to claim 1, further comprising:

a forming unit which forms a surface profile of the wire coated with the target material.

5. The extreme ultra violet light source apparatus according to claim 1, further comprising:

a cooling unit which cools the wire applied with the laser beam.

6. The extreme ultra violet light source apparatus according to claim 5, wherein said cooling unit cools the wire after the laser beam is applied to the wire to which the target material is coated, and said target material supplying unit coats the wire cooled by said cooling unit with the target material.

7. The extreme ultra violet light source apparatus according to claim 6, wherein said wire supplying unit retrieves the wire coated with the target material by said target material supplying unit.

8. The extreme ultra violet light source apparatus according to claim 1, wherein said wire supplying unit includes a wire drum which transfers the wire by rotating, said wire having a loop configuration and being wound around the wire drum.

9. The extreme ultra violet light source apparatus according to claim 8, wherein said wire supplying unit further includes a tension adjusting unit which adjusts tension of the wire being transferred by said wire drum.

10. The extreme ultra violet light source apparatus according to claim 1, wherein said target material supplying unit and said wire supplying unit are provided inside said chamber.

11. The extreme ultra violet light source apparatus according to claim 1, wherein said target material supplying unit and said wire supplying unit are provided outside said chamber.

* * * * *